US007287790B1

(12) United States Patent
Kitiashvili

(10) Patent No.: US 7,287,790 B1
(45) Date of Patent: Oct. 30, 2007

(54) DEVICE FOR ANIMAL WASTE RETRIEVAL

(76) Inventor: Davit Kitiashvili, 86-55 16 Ave., Brooklyn, NY (US) 11214

( * ) Notice: Subject to any disclaimer, the term of this patent is extended or adjusted under 35 U.S.C. 154(b) by 0 days.

(21) Appl. No.: 11/481,163

(22) Filed: Jul. 5, 2006

(51) Int. Cl.
*A01K 29/00* (2006.01)
*E01H 1/12* (2006.01)

(52) U.S. Cl. ..... 294/1.4

(58) Field of Classification Search ..... 294/1.3, 294/1.4, 1.5, 19.1; 119/802–805
See application file for complete search history.

(56) References Cited

U.S. PATENT DOCUMENTS 1,850,255 A * 3/1932 Amble ..... 119/803
3,540,769 A * 11/1970 Rosser ..... 294/19.1
3,777,708 A 12/1973 Vogt
3,819,220 A 6/1974 Bredt
3,977,422 A 8/1976 Cabaluna
3,984,139 A 10/1976 Battaglia
4,003,595 A * 1/1977 Fano et al. ..... 294/1.5
4,121,866 A 10/1978 Schall et al.
4,132,442 A 1/1979 Larsson
4,179,145 A 12/1979 Shinsako
4,225,169 A 9/1980 DeToma
4,254,979 A 3/1981 Bau
4,466,648 A 8/1984 Albiez
4,819,977 A 4/1989 Cooper
4,995,661 A 2/1991 Aurness
5,131,704 A 7/1992 Li
5,193,870 A 3/1993 MacInnis et al.
5,335,952 A 8/1994 Clapper
5,380,054 A 1/1995 Galvis
5,562,319 A 10/1996 Kohler
5,779,290 A 7/1998 Wilke
6,062,618 A 5/2000 Figueroa
6,068,311 A 5/2000 Jones
6,135,520 A 10/2000 Miller et al.
6,279,975 B1 8/2001 Gamliel
6,305,322 B1 10/2001 Patel
6,386,606 B1 5/2002 Marshall
6,527,320 B1 3/2003 Gregg
6,641,188 B2 11/2003 Arceo
6,827,378 B1 12/2004 Wong
6,941,896 B1 9/2005 Morin
6,983,966 B2 1/2006 Azrikam
7,080,863 B2 * 7/2006 Cappellano et al. ..... 294/1.4
2004/0135386 A1 7/2004 Pineda

* cited by examiner

*Primary Examiner*—Dean J Kramer
(74) *Attorney, Agent, or Firm*—Boris Leschinsky; Aleksandr Smushkovich

(57) ABSTRACT

A device for animal waste retrieval comprises a handle having a first latching member with a releasing member disposed at a first end of a guide, a support having a second latching member and a bag gripper disposed at a second end of the guide surface with a pull slidely coupled to it and biased toward the second end, an elongated flexible restrain with apertures proximate to its ends, wherein the restrain is so disposed that the apertures are substantially symmetrical to the support and generally opposite to the second end, and a flexible member is inserted through the apertures and attached to the pull thereby forming a loop. The device is simple, light-weighted, entirely sanitary, capable to pick up with one bag or more times, scoop, and catch the waste, comfortable and unobtrusive in use.

9 Claims, 3 Drawing Sheets

DEVICE FOR ANIMAL WASTE RETRIEVAL

BACKGROUND OF INVENTION

The present invention generally relates to cleaning implements and more particularly pertains to the field of hand-held devices and aids for the sanitary handling and disposal of solid waste and droppings from household pet animals.

Devices for the sanitary catching, pick-up, or scooping removal of pet excrement are already well known, since population density and the maintaining of proper sanitary conditions require the use of such devices. While generally effective, these devices are not totally satisfactory from the viewpoint of convenience of use.

The shortcomings are due to considerable tradeoffs and limitations imposed by their design.

Some of the existing devices, for example U.S. Pat. Nos. 5,380,054, 6,135,520, 6,641,188, 6,827,378, 6,941,896, and 6,983,966, are deficient in that the device itself must come into contact with the waste material and becomes contaminated and unsanitary. Efforts to avoid this problem have led to various designs which interpose a disposable bag or wrapper between the handling device and the waste, for example U.S. Pat. Nos. 3,777,708, 3,819,220, 3,977,422, 3,984,139, 4,121,866, 5,193,870, 5,562,319 and 6,386,606. These devices generally require the user to fit a fresh bag on the device prior to each use that, in most cases, requires certain effort on the side of the user. In some cases, bags specially designed for use with the particular device are required.

Furthermore, the existing devices are deficient in utility value they provide due to limiting the user to only one way of handling the task. The prior art devices intended, for example, for scooping the waste are not functional for either catching or picking it up and vice versa. Many of the prior art devices are complex and bulky. In addition, the existing devices lack full and reliable bag closing or the closing at all.

A continuing need therefore exists for pet waste retrieval and disposal device that is entirely sanitary, capable of picking up as well as scooping and catching the waste, do not require use of special disposal bags, provide for use one bag for multiple pick-ups, and is simple, light weight and compact so that it can be comfortably and unobtrusively carried along while walking a pet.

SUMMARY OF INVENTION

Generally, it is an object of the present invention to provide an improved animal waste retrieval device overcoming the foregoing and other shortcomings of the prior art.

Specifically, it is an object of the present invention to provide-the device capable of catching, scooping, and picking up excrements; utilizes a commonly available disposable easy on-easy off removable bags that can be used multiple times before the disposal; fully and reliably closes the bag between uses; and which is light weight and compact so that it can be comfortably and unobtrusively carried along while walking a pet.

Accordingly, a key aspect of embodiments of the invention feature a device for animal waste retrieval comprising a handle having a first latching member with a releasing member disposed at a first end of a guide, a support having a second latching member and a bag gripper disposed at a second end of the guide, a guiding surface with a pull slideably coupled to it and biased toward the second end, an elongate flexible restrain with apertures proximate to it ends wherein the restrain disposed so the apertures are substantially symmetrical to said support and generally opposite to said second end, and a flexible member inserted through said apertures and attached to said pull thereby forming a loop.

In general, in one aspect, the embodiments of the invention feature a compression spring disposed between the pull and the handle, the support has substantially symmetrical holes at said second end of the guide and the flexible member inserted through said holes thereby said flexible member further restrained and guided to said pull.

In general, in another aspect, the embodiments of the invention feature the bag gripper comprising a hole formed in said support generally parallel with said loop and an elastic membrane disposed over at least one end of said hole wherein said elastic membrane has at least one approximately diametric slit.

In general, in yet another aspect, the embodiments of the invention feature the device wherein said flexible member is a spring wire and may comprise at least one section with high friction surface.

In general, in still another aspect, the embodiments of the invention feature the device wherein said flexible member is a spring band.

In general, in a further aspect, the embodiments of the invention feature the device wherein said flexible member comprises of two spring bands having one end attached to the pull and a string disposed between other ends of said spring bands where a length of the string is comparable to a length of the flexible restrain.

In general, in a different aspect, the embodiments of the invention feature the device wherein the guide comprised a tube having slots, the pull disposed inside said tube and attached through said slots to a sliding handle disposed around the tube, said slots, accordingly, provide for moving of the pull between said first latching member and a second latching member that disposed to latch said sliding handle.

In general, in yet another aspect, the embodiments of the invention feature the device comprising a cover disposed around the guide and the pull and a sliding handle disposed around said cover and attached to the pull through slots in said cover, said slots, accordingly, provide for moving of the pull between said first latching member and a second latching member that disposed to latch said sliding handle.

DETAILED DESCRIPTION

Figure 1A:
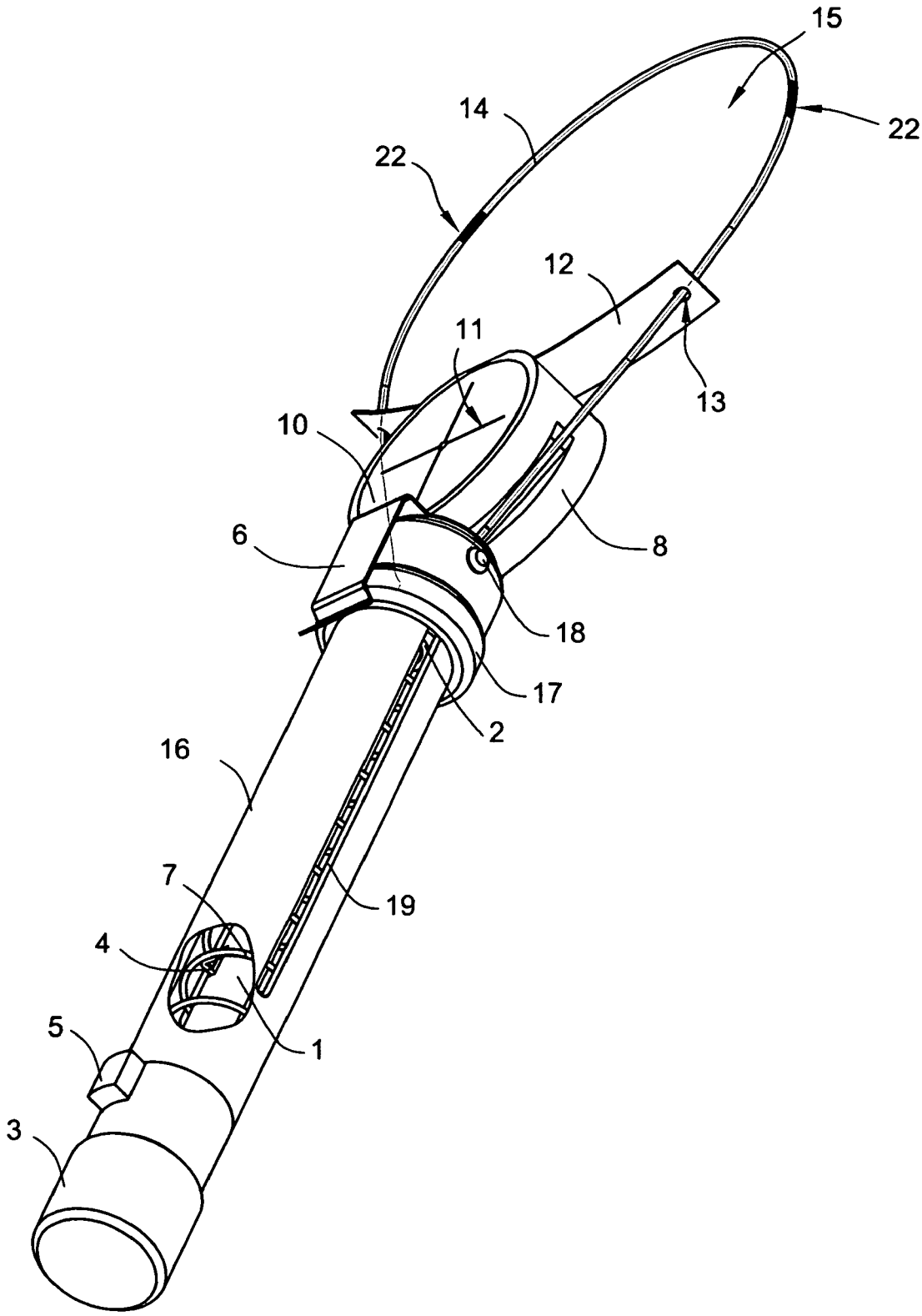
FIG. 1A depicts an embodiment of the invention in extended position.
Figure 1B:
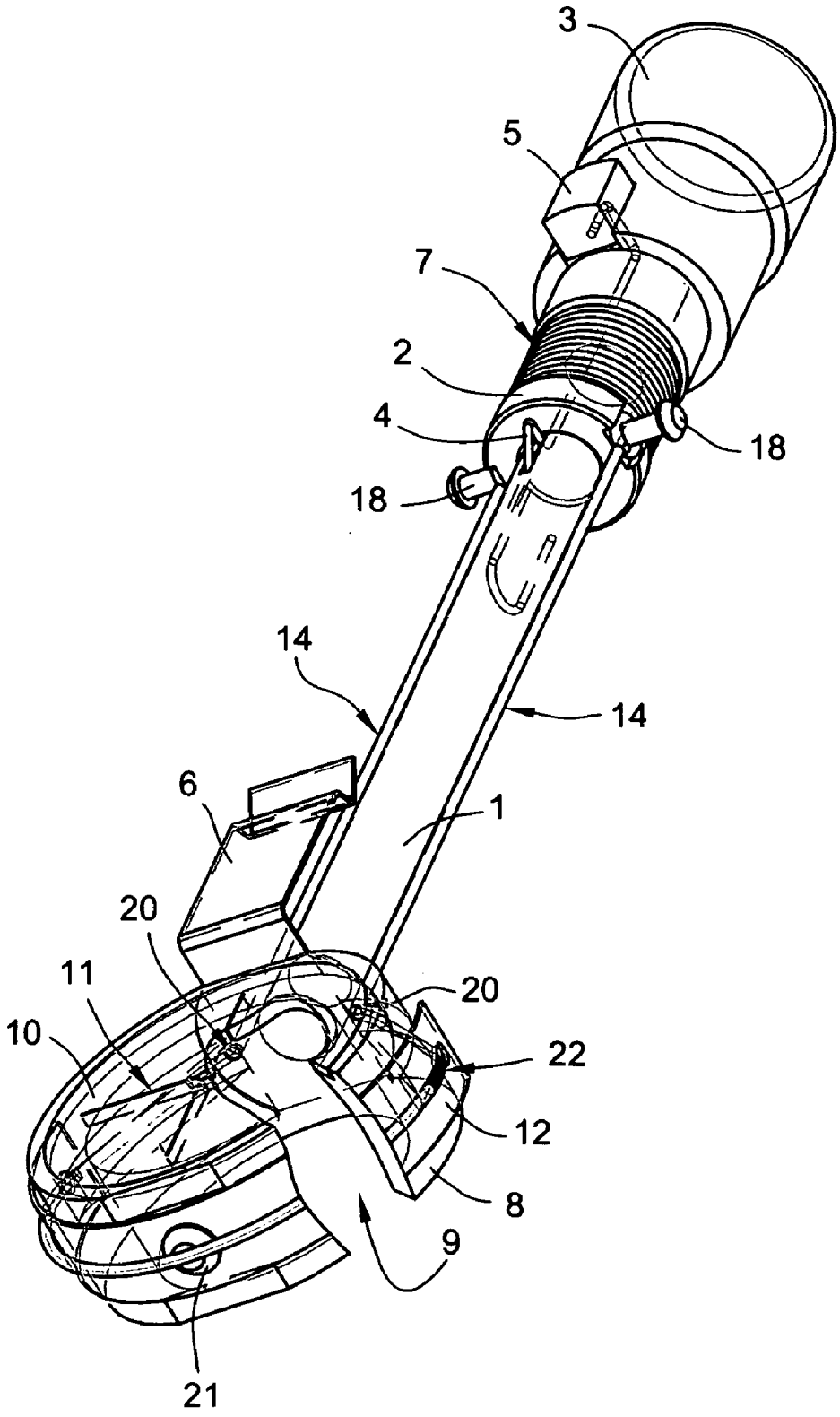
FIG. 1B depicts the embodiment of the invention in retracted position with the cover and the handle removed.

One of the embodiments of the present invention is a device (FIGS. 1A and 1B) comprising a hollow rod 1, a handle 3 with a pushbutton 5 attached to first end of the rod 1, and a latch 4 positioned in the rod 1 and the handle 3 wherein the latch 4 protrudes through a slot in the rod 1 and engages the pushbutton 5. A slide 2 moveable along the rod 1 is biased to second end of the rod 1 by a spring 7 placed around the rod 1 between the handle 3 and the slide 2. A support 8 having a hole 9 and a membrane 10 with slits 11 is disposed at the second end of the rod 1 along with a stopper 6. A flexible guide 12 with holes 13 is attached by a screw 21 to the support 8 opposite the second end of the rod 1. A spring wire 14 is inserted through the holes 13 and holes 20 in the stopper 6 and attached to the slide 2 with screws 18 thereby forming a loop 15 in extended position (FIG. 1A). A tubular cover 16 having slots 19 is positioned around the spring 7 and slide 2 between the handle 3 and the support 8. A sliding handle 17 moveable over the cover 16 attached with the screws 18 through the slots 19 to the slide 2. The wire 14 has high friction (knurled) areas 22 that do not reach into the holes 13 in retracted position (FIG. 1B).

There is a number of alternative designs of aforementioned embodiment of the present invention wherein, for example, the handle 3 comprises telescopic parts for increasing length of the device, the holes 20 are in the support 8 instead of the stopper 6, two membranes 10 covering both sides of the hole 9, rough surfaced sleeves or beads are set onto the wire 14 in place of the areas 22 or the wire 14 may be flat with corresponding shape of the holes 13 and 20.

The disclosed embodiment of the present invention works as follows. A bag is positioned in the loop 15 with its opening folded over the wire 14 thereby forming a cuff and any slack pushed into the membrane 10 with slits 11. The excrements collection may be accomplished in three different ways. First, the device scoops/scrapes the excrements from the ground. In that case (FIG. 1A) the wire 14 and, accordingly, the bag readily conforms to fairly uneven surface while holes 13 and 20 limit undesirable flexibility of the wire 14. The stopper 6 holds the sliding handle 17 and, correspondingly, the slide 2 in extended position that prevents the loop 15 from closing. Subsequently (FIG. 1B), a user retracts the sliding handle 17 with the screws 18, the slide 2, and the wire 14 until the latch 4 catches the slide 2. Consequently, the bag is tightly constricted between the wire 14 and the flexible guide 12, which is bent by the wire 14 around the support 8.

Second, for picking up the excrements, the device is turned with the bag opening down, placed with the loop 15 encompassing the waste on the ground, and a user retracts the sliding handle 17 with the screws 18, the slide 2, and the wire 14 until the latch 4 catches the slide 2. Consequently, the waste is forced inside the bag that is tightly constricted between the wire 14 and the flexible guide 12, which is bent by the wire 14 around the support 8.

Third, for catching the excrements, the device is positioned to receive them directly. For users preferring this way, the embodiment with the telescoping handle 3 would be most helpful. The bag closing is disclosed above.

Either way the same bag may be used more than once. Pushing the pushbotton 5 forces the latch 4 to release the slide 2, which is moved by the spring 7 until the stopper 6 latches the sliding handle 17. The extending wire 14 forms the loop 15 and forces the bag to open generally into initial position that enables a user to repeatedly collect the excrements. To dispose contents of the bag, the user should pull out the part of the bag pushed through the membrane 10 and shake the device downward over the place of disposal.

Figure 2:
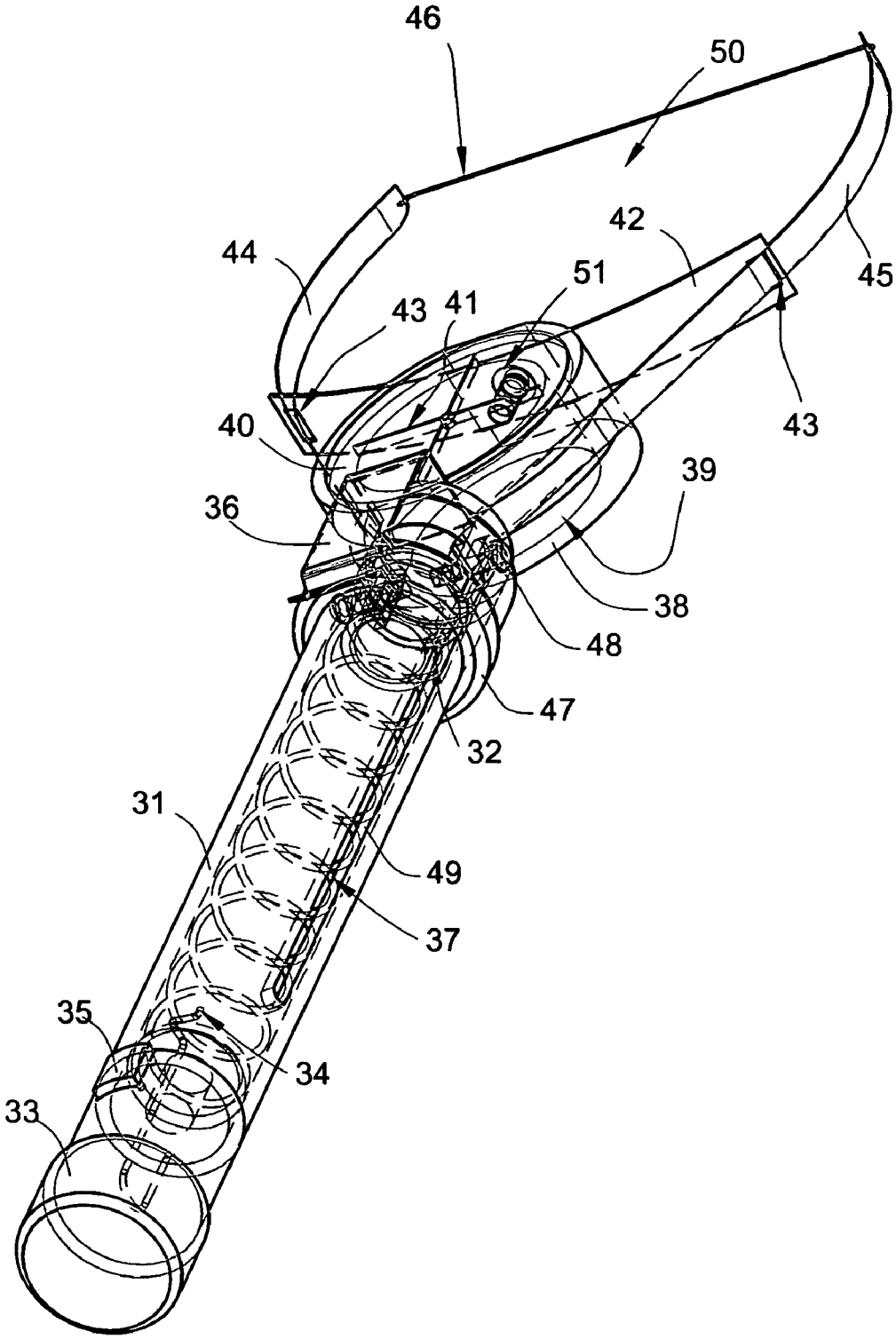
FIG. 2 depicts another embodiment of the invention in extended position.

Another embodiment of the present invention is a device (FIG. 2) comprising a hollow rod 31 with slots 49, a handle 33 with a pushbutton 35 attached to first end of the rod 31, and a latch 34 positioned in the handle 33 and engaged the pushbutton 35. A slide 32 moveable inside the rod 31 is biased to second end of the rod 31 by a spring 37 placed between the handle 33 and the slide 32. A support 38 having a hole 39 and a membrane 40 with slits 41 is disposed at the second end of the rod 31 along with a stopper 36. A flexible guide 42 with slots 43 is attached by a screw 51 to the support 38 opposite the second end of the rod 31. Flat springs 44 and 45 are inserted through the slots 43 with their first ends attached to the slide 32 by screws 48 and second ends connected with a string 46 thereby forming a loop 50. A sliding handle 47 moveable over the rod 31 attached with the screws 48 through the slots 49 to the slide 32. The string 46 does not reach into the slots 43 in retracted position. Depending on materials used, different methods, such as brazing, gluing, or fixing mechanically could be employed for the connecting the string 46 to the flat springs 44 and 45.

This embodiment works generally the same way as disclosed previously. The flat springs 44 and 45 make the loop 50 firmer in the direction perpendicular to it and the string 46 relatively straight edge that may be preferred when excrements to be collected from mostly flat surfaces.

Regarding the above description, it is to be recognized that the optimum dimensional relationships for the parts of the invention, including variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Although the description above contains much specificity, it should not be construed as limiting the scope of the invention but as merely providing illustrations of some of the presently preferred embodiments of this invention. Thus the scope of the invention should be determined by the appended claims and their legal equivalents, rather than by the examples given. It will be apparent to those skilled in the art that various modifications and variations can be made to the above-described structure and methodology without departing from the scope or spirit of the invention.

What is claimed is:

1. A device for animal waste retrieval comprising:

a guide having a first end, a second end, and a guiding surface;

a handle including a first latching member with a releasing member disposed at said first end of said guide;

a pull slidely coupled to said guiding surface of said guide and biased toward said second end of said guide;

a support disposed at said second end of said guide including a second latching member and a bag gripper;

an elongated flexible restrain including apertures proximate to ends of said restrain, said restrain so disposed that said apertures being substantially symmetrical relatively to said support and opposite to said second end of said guide;

a flexible member inserted through said apertures and attached to said pull thereby forming a loop; and a compression spring disposed between said pull and said handle.

2. A device for animal waste retrieval comprising:

a guide having a first end, a second end, and a guiding surface;

a handle including a first latching member with a releasing member disposed at said first end of said guide;

a pull slidely coupled to said guiding surface of said guide and biased toward said second end of said guide;

an elongated flexible restrain including apertures proximate to ends of said restrain said restrain so disposed that said apertures being substantially symmetrical relatively to a support, and opposite relatively to said second end of said guide;

a flexible member inserted through said apertures and attached to said pull thereby forming a loop;

said support disposed at said second end of said guide including a second latching member;

a bag grippers;

substantially symmetrical holes situated at said second end of said guide, and said flexible member inserted through said holes, thereby said flexible member further restrained and guided to said pull.

3. A device for animal waste retrieval comprising:

a guide having a first end, a second end, and a guiding surface;

a handle including a first latching member with a releasing member disposed at said first end of said guide;

a pull slidely coupled to said guiding surface of said guide and biased toward said second end of said guide;

a support disposed at said second end of said guide including a second latching member and a bag gripper;

an elongated flexible restrain including apertures proximate to ends of said restrain, said restrain so disposed that said apertures being substantially symmetrical relatively to said support and opposite to said second end of said guide; and a flexible member inserted through said apertures and attached to said pull thereby forming a loop; wherein said bag gripper including a hole formed in said support generally parallel with said loop and an elastic membrane having at least one approximately diametric slit.

4. The device according to claim 3, wherein said flexible member being a spring wire including at least one section with a higher friction surface.

5. The device according to claim 3, wherein said flexible member of comprising two spring bands, each having one end attached to said pull and a string disposed between other ends of said spring bands, wherein the length of said string being comparable to the length of said elongated flexible restrain.

6. The device according to claim 3, wherein said guide including a tube having slots, said pull disposed inside said tube, and attached through said slots to a sliding handle disposed around said tube, wherein said slots providing for moving said pull between said first and second latching members.

7. The device according to claim 6, wherein said second latching member so disposed that it is capable to latch said sliding handle.

8. The device according to claim 3, comprised further comprising a cover disposed around said guide and said pull, and a sliding handle disposed around said cover and attached to said pull through slots in said cover wherein said slots providing for moving said pull between said first and second latching members.

9. The device according to claim 8, wherein said second latching member so disposed that capable to latch said sliding handle.

* * * * *